United States Patent [19]

Lundström et al.

[11] Patent Number: 4,471,336

[45] Date of Patent: Sep. 11, 1984

[54] INDUCTIVE APPARATUS

[75] Inventors: Lennart Lundström; Bertil Moritz, both of Ludvika, Sweden

[73] Assignee: ASEA Aktiebolag, Västeras, Sweden

[21] Appl. No.: 563,429

[22] Filed: Dec. 20, 1983

[30] Foreign Application Priority Data

Feb. 10, 1983 [SE] Sweden ..... 8300712

[51] Int. Cl.[3] ..... H01F 27/28

[52] U.S. Cl. ..... 336/206; 336/223; 336/225

[58] Field of Search ..... 336/232, 223, 206, 222, 336/225, 228, 60, 207

[56] References Cited

U.S. PATENT DOCUMENTS

| | | | |
|---|---|---|---|
| 1,331,077 | 2/1920 | Moody | 336/223 X |
| 1,825,105 | 9/1931 | Tenman | 336/223 X |
| 3,464,043 | 8/1968 | Benko et al. | 336/223 X |
| 3,634,800 | 1/1972 | Fisher | 336/223 X |
| 3,691,498 | 9/1972 | Zwelling et al. | 336/206 X |
| 3,928,832 | 12/1975 | Forsberg et al. | 336/223 X |
| 4,259,654 | 3/1981 | Persson et al. | 336/223 |
| 4,323,870 | 4/1982 | Moritz et al. | 336/206 |

*Primary Examiner*—Thomas J. Kozma

*Attorney, Agent, or Firm*—Pollock, Vande Sande & Priddy

[57] ABSTRACT

A sheet winding (7) in a transformer is made with double-curved conductor sheets. Some of the winding turns are mutually different as regards the curvature visible in an axial section. This has been achieved by arranging a number of filling members at each one of the end surfaces of the winding. Each filling member contains several turns of a filling tape (14), which are evenly distributed in a group of mutually adjacently positioned winding turns wound from a conductor sheet (9). Because the filling tape has different degrees of overlap in the different turns of the conductor sheet (9), the filling member will have approximately the same effect as a filling body which, in axial section, exhibits a wedge-shaped cross-section area.

2 Claims, 7 Drawing Figures

FIG. 3B
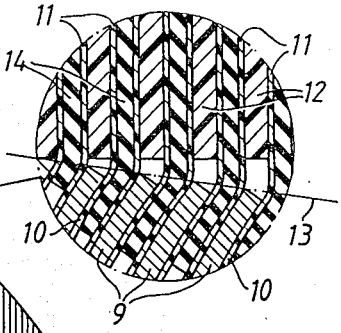
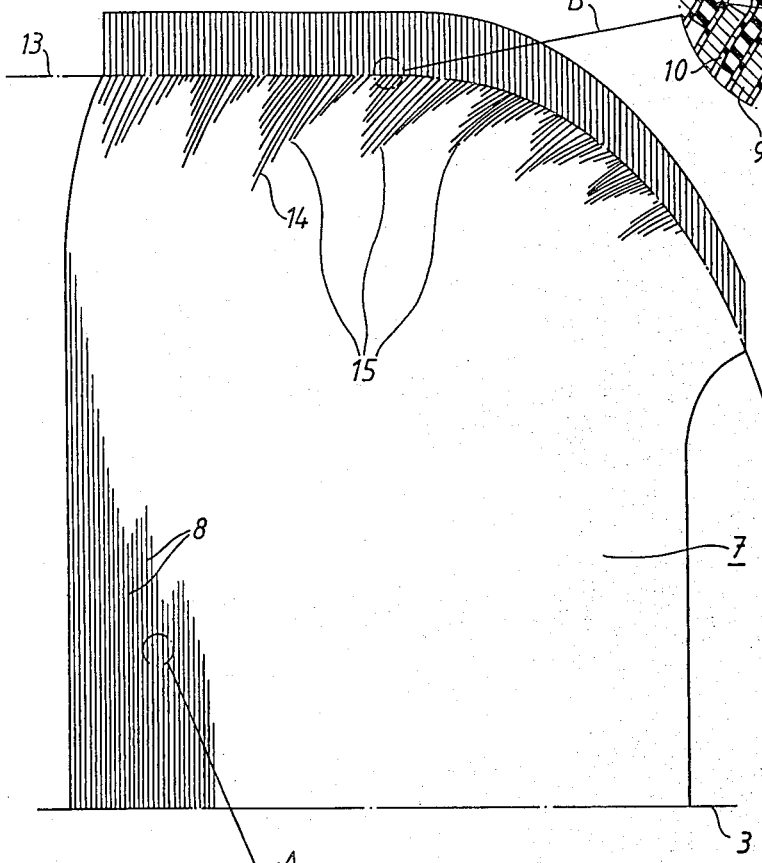
FIG. 3
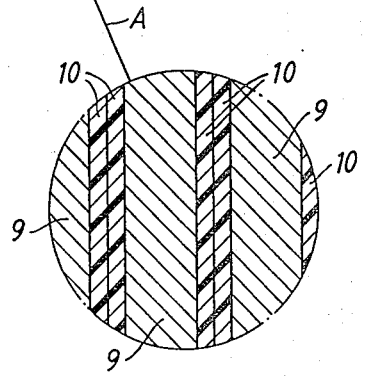
FIG. 3A
FIG. 4
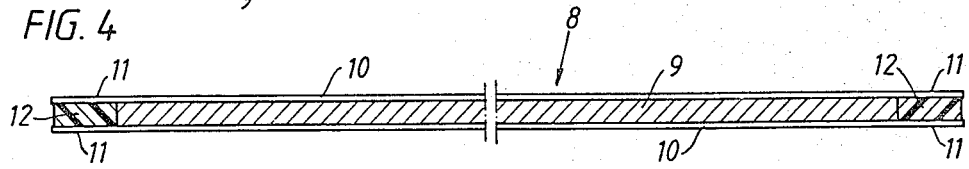

INDUCTIVE APPARATUS

The present invention relates to an inductive apparatus, usually a power transformer or reactor, comprising a laminated magnet core with at least one core leg as well as at least one winding arranged substantially coaxially to an axis in said core leg, said winding comprising a plurality of winding turns—arranged radially one after the other—of a conductor sheet provided with conductor insulation, each one of said winding turns substantially constituting a solid of revolution arranged around said axis, which solid of revolution—at least partially—is limited in a radial direction by means of a double-curved limiting surface, whereby the maximum curvature of said solid of revolution, visible in an axial section through the winding, at least in part of the winding increases in a radial direction due to the fact that a plurality of pairs of immediately consecutive winding turns are each provided with a spacer arranged between the two winding turns of the pair, the total thickness of a plurality of such spacers, measured in an imaginary surface parallel to the nearest metallic end surface of the winding, is relatively great in the vicinity of said end surface and decreases with increasing distance therefrom.

An apparatus of the above-described kind is known from U.S. Pat. No. 4,323,870, which describes a transformer with a sheet winding, in which each one of the above-mentioned spacers consists of an electrically insulating strip having wedge-shaped cross-section. The greatest thickness of each strip is relatively great, and therefore the strips will be stiff and little workable. The arrangement of a plurality of such strips in the known sheet winding involves discontinuity in the winding process and therefore a considerable reduction of the rate of production.

The task that is sought to be solved by the present invention is to provide a sheet winding which has the properties mentioned in the introduction and which enables manufacture with greater rate of production than the above-mentioned known winding, and to design and arrange the spacers, necessary for the described double-curved shape of the winding turns, in such a way that, in addition to acting as distance bodies, they provide a considerable reduction of the probability of flash-over between mutually adjacently located winding turns.

What characterizes the invention will become clear from the appendant claims.

In the following the invention will be described with reference to the accompanying schematic drawings, wherein:

FIG. 3 shows a detail of FIG. 2 on an enlarged scale;

FIG. 3A shows an enlargement of a region which is encircled on FIG. 3 by a dotted circle, which is connected by line A to FIG. 3A;

FIG. 3B shows an enlargement of a region which is encircled on FIG. 3 by a dotted circle, which is connected by line B to FIG. 3B;

FIG. 4 shows a cross-section of a sheet-formed, insulated conductor which is included in a sheet winding shown in FIG. 3.

Figure 5:
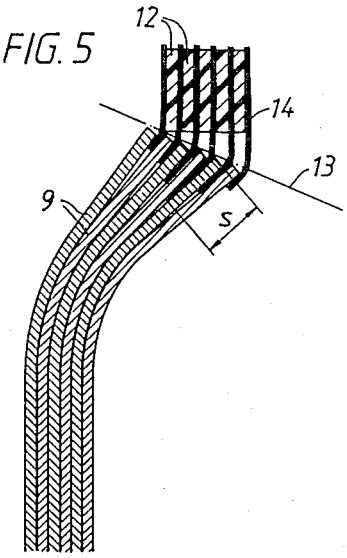
FIG. 5 shows—in an axial section through the winding—a filling device which contains a plurality of spacers arranged according to the invention.
Figure 1:
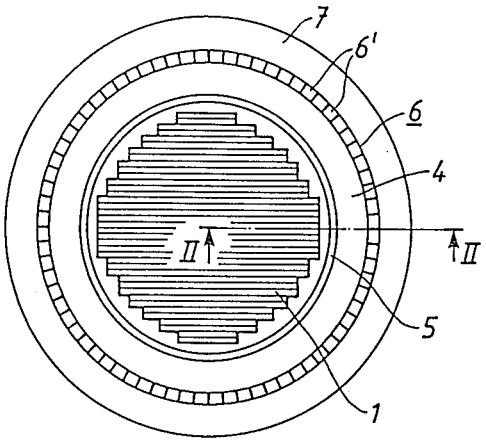
FIG. 1 shows a section perpendicular to a core leg of a power transformer designed according to the invention.
Figure 2:
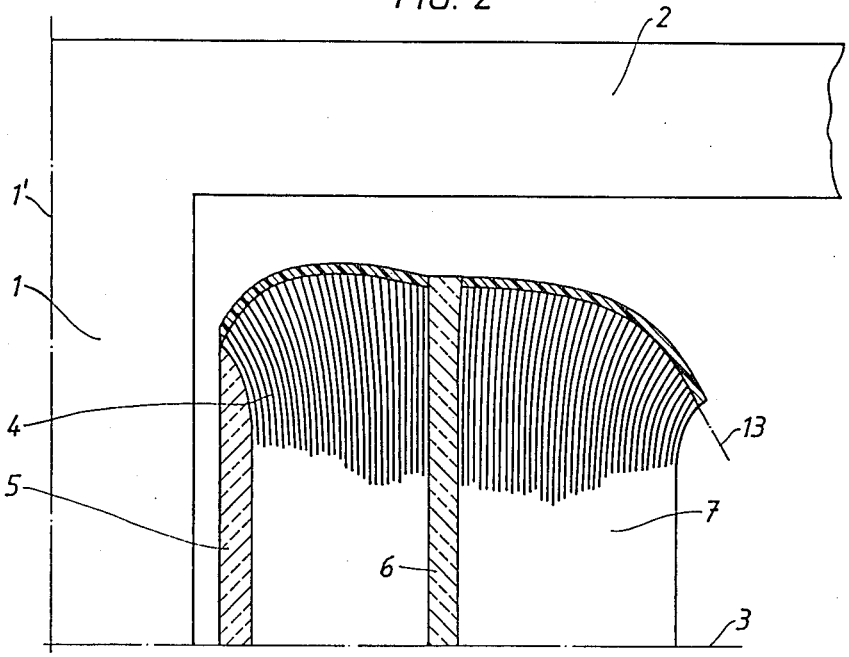
FIG. 2 shows the same transformer in partial section along II—II of FIG. 1.

In the drawings, 1 designates a core leg of a laminated transformer core. The core leg 1 has a vertical symmetry axis 1' and is arranged between an upper yoke 2 and a lower yoke (not shown in the drawings). An imaginary horizontal middle plane on the core leg 1 is marked by a dash-dotted line 3. An inner winding 4 is wound on a supporting cylinder 5, the axis of which substantially coincides with the axis 1'. The inner winding 4 is surrounded by a substantially tubular channel 6 made of electrically insulating material and by a an outer winding 7 arranged radially outside said channel and coaxially in relation to the inner winding. The channel 6 is composed of a plurality of axial ribs 6' made of electrically insulating material and arranged tangentially one after the other. Each one of the two windings 4 and 7 is made in the form of a sheet winding. The outer winding 7 comprises a plurality of turns of a sheet 8 wound radially one after the other. The sheet 8 comprises a conductor sheet 9 of even thickness made of electrically conducting material, the thickness of which being in the range of 0.1–4 mm and the width of which being approximately equal to the maximum axial extension of the current-carrying part of the winding. On each side the conductor sheet 9 is provided with a corresponding film tape 10 of relatively thin, electrically insulating material. The film tape 10 has greater width than the conductor sheet 9, and each film tape 10 has two edge portions 11, which lie outside the conductor sheet 9 at a corresponding edge thereof. At each edge of the sheet 8 there is arranged an edge tape 12 of insulating material, for example cellulose paper, outside the conductor sheet and between edge portions 11 located there.

The winding 7 includes a plurality of turns of the conductor sheet 9, the same number of turns of each one of the two edge tapes 12, and at each end of the winding approximately the same number of turns of a special filling tape 14, preferably made of insulating material. In the winding 7, the upper edge of the conductor sheet 9 touches an imaginary surface of revolution 13. A filling tape 14 has rectangular cross-section and is made with constant thickness also in its longitudinal direction. Each of a plurality of portions of the winding 7, arranged radially one after the other, is provided with a filling device 15 in the form of a plurality of turns of the filling tape 14, whereas each turn is arranged between two immediately consecutively arranged turns of the sheet 8. In each filling device 15 the different turns of the filling tape 14 are arranged with different axial positions, and therefore their resulting effect is approximately the same as the effect of each of the strips of wedge-shaped cross-section mentioned in the introduction and used in the known transformer mentioned above. The principle is clearly illustrated in FIG. 5, which shows one of the above-mentioned winding portions provided with a filling device 15. The filling device comprises six turns of the filling tape 14. These six turns are arranged with four different degrees of overlap in relation to the adjacent turns of the conductor sheet 9. In FIG. 5, the width of the overlap zone of the turn of the filling tape 14 arranged with the greatest overlap is designated with the letter S. In three of the shown six turns, the corresponding width is smaller than S/2, whereas the width of the overlap zone of two other turns is greater than S/2 and smaller than $0.9 \times S$. In a plurality of the filling devices 15 shown in FIG. 3, the number—within each device—of filling tape turns which are different among themselves as regards the degree of overlap, is considerably greater than with the filling device shown in FIG. 5. In each filling device 15, the total thickness of the spacers formed by the taper 14—measured in an imaginary surface parallel to the nearest metallic end surface 13 of the winding 7—is relatively great in the vicinity of said end surface and decreases with increasing distance therefrom.

During manufacture of the winding 7, even the first, i.e. the radially innermost turn of the sheet 8, is formed with double-curved shape since the channel 6 has a radially outwardly facing, double-curved surface. Approximately at the same time, the winding of a filling tape 14 onto each edge of the conductor sheet 9 is started. The sheet 8 may alternatively be prefabricated, but preferably the sheets 9, 10 and the edge tape 12 are put together during the winding operation only, whereby these, and also the tapes 14, are wound onto the channel 6 by rotating this channel. Due to the rotation the sheets and the tapes are pulled from corresponding braked storage rollers. The storage rollers intended for feeding out the tapes 14 are arranged to be able to be displaced in the axial direction, and their axial positions are controlled by a programmed control system. If there occurs a winding interval in which no increase in the curvature visible in an imaginary axial section is desired, the filling tape 14 is cut off, or wound completely outside the edges of the conductor sheet during this interval. Alternatively, each filling tape 14 may consist of a plurality of partial tapes, which are positioned with their flat sides against each other and which are each fed out from a corresponding storage roller. By varying the number of partial tapes, it is then possible to vary the thickness of the shown filling tape 14, for example in such a way that some of the portions, which are wound outside the imaginary surface 13 only, are made with smaller tape thickness than the others. If the total number of the abovementioned overlap zones is relatively small and, in addition, the filling tape 14 is made with relatively large thickness, the edge tape 12 is suitably made with a thickness which is considerably smaller than the thickness of the conductor sheet, for example smaller than 80% thereof.

When the winding 7 is completed, its end surfaces are turned in a lathe, whereby redundant parts of the filling tape 14—as well as redundant parts of the edge tapes 12—are removed.

When a winding according to the invention at each end is provided with an electrically insulating filling tape, which to a smaller or greater extent overlaps all the turns of the conductor sheet or a large number of such turns, for example more than 50% of the total number, the probability of flash-over between mutually positioned winding turns is considerably reduced, since the risk of such flash-overs is greatest at the places where the edges of the conductor sheet are to be found.

The inner winding 4 is formed in a manner similar to the winding 7. In the innermost winding turn, the curvature visible in an axial section is relatively great. In the subsequent winding turns, the curvature is reduced by means of a plurality of filling devices (not shown in the drawing), which are made substantially as shown in FIG. 5.

The transformer described with reference to the drawings only constitutes one of a plurality of conceivable embodiments of the invention.

Thus, the inner winding 4 need not be made as a sheet winding.

Further, the manufacture can be performed in such a way that—instead of varying the axial position of the tape 14 having even thickness for the purpose of being able to vary the degree of overlap in the desired manner—a larger or smaller portion of the tape at its axially inner edge can be cut away by allowing the tape 14, during the winding on, to pass through a cutting device with variable position.

Instead of a conducting sheet having a width approximately corresponding to the axial dimension of the winding, two conducting sheets having half of this width can be arranged side by side. Also a greater number of conducting sheets can be wound between each other in parallel connection.

We claim:

1. Inductive apparatus comprising a laminated magnet core having at least one core leg (1) and at least one winding (7) arranged coaxially with an axis (1') in said core leg, said winding comprising a plurality of winding turns, radially one after the other, of a conductor sheet (9) provided with conductor insulation (10), each one of said winding turns substantially constituting a solid of revolution, arranged around said axis (1'), which solid of revolution—at least partially—is limited in the radial direction by means of a double-curved limiting surface, whereby the maximum curvature visible in an axial section through the winding, of said solid of revolution, at least in part of the winding increases in a radial direction, a plurality of pairs of immediately consecutive winding turns being each provided with a spacer arranged between the two consecutive winding turns, the total thickness of a plurality of said spacers, measured in an imaginary surface parallel to the nearest metallic end surface (13) of the winding, being relatively great in the vicinity of said end surface (13) and smaller at a greater distance therefrom, characterized in that each one of said spacers has substantially constant thickness and consists of a substantially annular portion of a filling tape (14) which is wound along an edge of said conductor sheet (9) with a certain degree of overlap, the width (S) of the overlap zone with at least one of said spacers being greater than the width of the overlap zone with some of the remaining spacers.

2. Inductive apparatus as claimed in claim 1, characterized in that the widths of several relatively wide overlap zones are different among themselves and at least twice the widths of several remaining overlap zones.

* * * * *